United States Patent [19]

Conrad et al.

[11] 4,198,948

[45] Apr. 22, 1980

[54] INSTALLATION FOR THE METERED LUBRICATION OF AN INJECTION PUMP FLANGEDLY CONNECTED TO AN INTERNAL COMBUSTION ENGINE

[75] Inventors: Ulrich Conrad, Ludwigsburg; Gerd Niemeier, Stuttgart, both of Fed. Rep. of Germany

[73] Assignee: Daimler-Benz Aktiengesellschaft, Fed. Rep. of Germany

[21] Appl. No.: 961,928

[22] Filed: Nov. 20, 1978

[30] Foreign Application Priority Data

Nov. 30, 1977 [DE] Fed. Rep. of Germany ..... 2753332

[51] Int. Cl.[2] ..... F01M 1/06

[52] U.S. Cl. ..... 123/196 R; 123/139 R

[58] Field of Search ..... 123/139 R, 139 AA, 139 BC, 123/196 R, 196 V; 184/6.8, 26, 6.28

[56] References Cited

U.S. PATENT DOCUMENTS

| | | | |
|---|---|---|---|
| 2,391,221 | 12/1945 | Beeh | 123/139 BC |
| 3,401,572 | 9/1968 | Bailey | 123/139 R |
| 3,637,049 | 1/1972 | Butterfield et al. | 184/6.28 |

*Primary Examiner*—Ira S. Lazarus
*Assistant Examiner*—M. Moy
*Attorney, Agent, or Firm*—Craig and Antonelli

[57] ABSTRACT

An installation for the metered lubrication of an injection pump flangedly connected to an internal combustion engine, in which the cam shaft is driven by an intermediate gear shaft non-rotatably connected therewith, which is rotatably supported in the crankcase of the internal combustion engine on two slide bearings and which is lubricated from a connection with a lubricating oil channel of the internal combustion engine; at least one of the slide bearings of the intermediate gear shaft is constructed in conjunction with the same as metering device; the metered lubricating oil, after leaving the slide bearing, is supplied by way of a sealed space formed at the connecting place between the cam shaft and the intermediate gear shaft, to a central bore through the cam shaft of the injection pump, from where the lubricating oil reaches the injection pump through a radial bore.

11 Claims, 2 Drawing Figures

Figure 1:
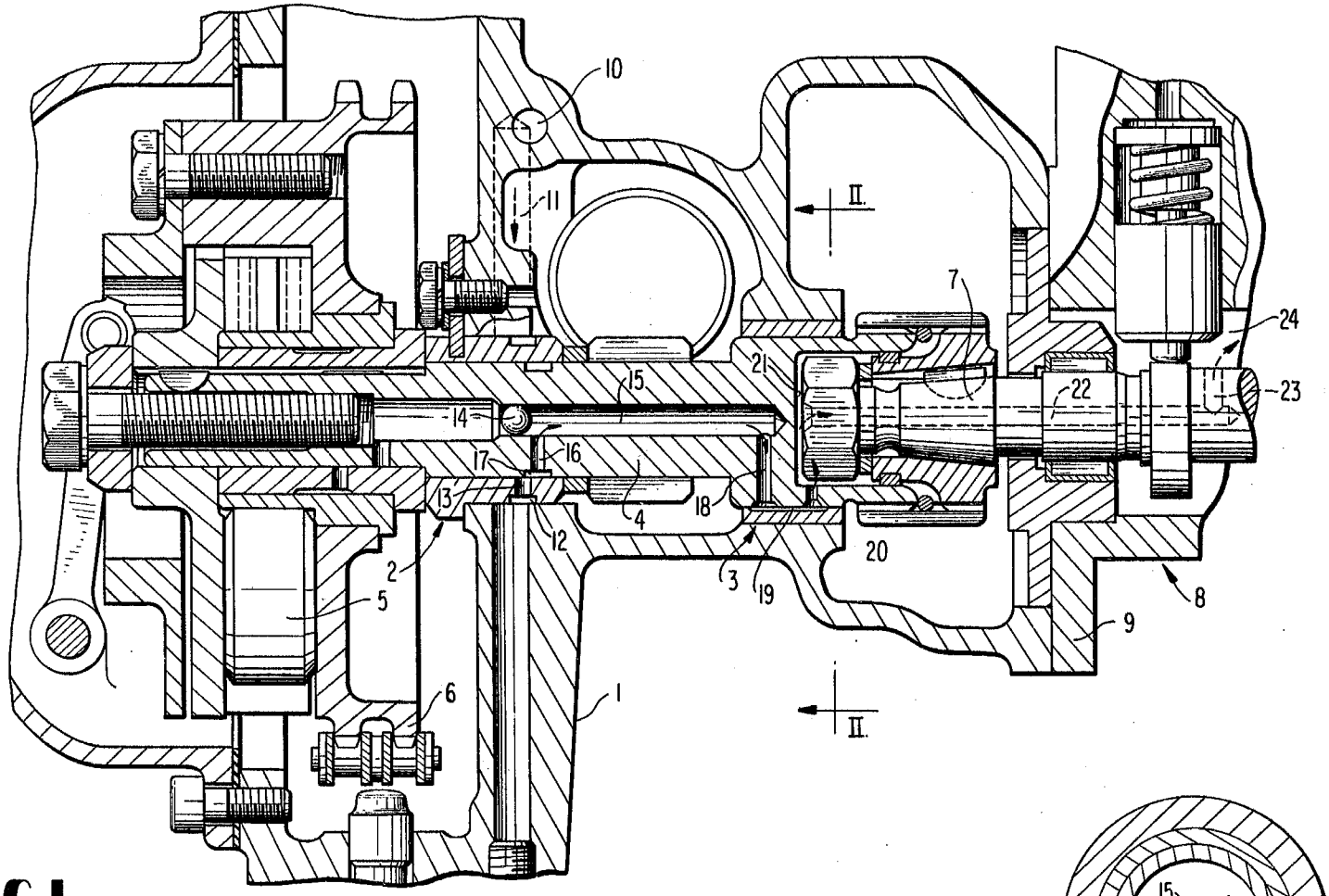

INSTALLATION FOR THE METERED LUBRICATION OF AN INJECTION PUMP FLANGEDLY CONNECTED TO AN INTERNAL COMBUSTION ENGINE

The present invention relates to an installation for the metered lubrication of an injection pump flangedly connected to an internal combustion engine, in which the cam shaft is driven from an intermediate gear shaft non-rotatably connected therewith, which intermediate gear shaft is supported in the crankcase of the internal combustion engine on two friction or slide bearings and is lubricated by a connection with a lubricating oil channel of the internal combustion engine.

The present invention is concerned with the task, on the one hand, to avoid the heretofore customary feed of lubricating oil to the injection pump by means of a hose line or pipe line, because notwithstanding careful layout and appropriate construction of the feed line, a rupture of this line and therewith an endangering of the entire internal combustion engine can never be completely precluded, and, on the other, to indicate a simple metering possibility which can be readily matched to the requirements in lubricant of the injection pump.

The underlying problems are solved according to the present invention in that at least one friction or slide bearing of the intermediate gear shaft is constructed in conjunction with the latter as metering device and the metered lubricating oil, after leaving the last slide or friction bearing, is fed to a central bore through the cam shaft of the internal combustion engine by way of a sealed space located at the connecting place of the cam shaft with the intermediate gear shaft and formed between these two shafts, from where the lubricating oil reaches the injection pump through a radial bore.

According to a further feature of the inventive subject matter, both friction or slide bearings may be constructed as series-connected metering devices disposed one behind the other. Furthermore, the lubricating oil channel in the crankcase may be connected for purposes of forming one metering device with an annular space of one slide or friction bearing of the intermediate gear shaft, which is operatively connected with a bore in the center longitudinal axis of the intermediate gear shaft by way of a radial bore through the one bearing in communication with a radial bore possibly slightly offset in the axial direction with respect thereto in the intermediate gear shaft, whereby the second metering device is then operatively connected with the bore in the center longitudinal axis of the intermediate gear shaft.

For purposes of forming the other metering device, the bore in the center longitudinal axis of the intermediate gear shaft may be connected by way of a radial bore with an oil pocket provided in the bearing, from which the lubricating oil reaches by way of a second radial bore disposed offset in the circumferential direction of the intermediate gear shaft with respect to the first radial bore, the space between the two shafts and from there the central bore in the cam shaft.

Accordingly, it is an object of the present invention to provide an installation for the metered lubrication of an injection pump flangedly connected to an internal combustion engine, which avoids by simple means the aforementioned shortcomings and drawbacks encounterd in the prior art.

Another object of the present invention resides in a metering device for the lubrication of an injection pump flangedly connected with an internal combustion engine which greatly increases the safety of the engine.

A further object of the present invention resides in a metering device for the lubrication of an injection pump mounted at an internal combustion engine, which obviates the need for hose or pipe lines to conduct the lubricant.

Still another object of the present invention resides in a metering device for the metered lubrication of an injection pump of the type described above which enables an easy matching of the system to the lubricant requirements of the injection pump.

Figure 2:
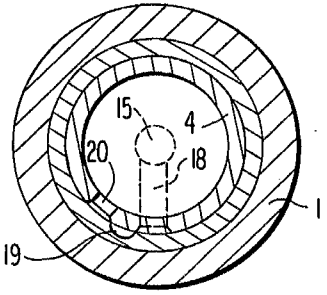

These and other objects, features and advantages of the present invention will become more apparent from the following description when taken in connection with the accompanying drawing which shows, for purposes of illustration only, one embodiment in accordance with the present invention, and wherein:

FIG. 1 is an axial longitudinal cross-sectional view through the drive of an injection pump with a metered lubrication system in accordance with the present invention; and FIG. 2 is a cross-sectional view taken along line II—II of FIG. 1.

Referring now to the drawing wherein like reference numerals are used throughout the two views to designate like parts, according to FIG. 1, an intermediate gear shaft 4 is rotatably supported in the housing 1 of an internal combustion engine by means of the friction or sleeve bearings generally designated by reference numerals 2 and 3; the intermediate gear shaft 4 carries at one end an injection timing device 5 with a drive gear 6 and is non-rotatably connected at the other end thereof with the cam shaft 7 of the injection pump generally designated by reference numeral 8, whose housing 9 is flangedly connected to the housing 1 of the internal combustion engine.

An annular space 12 at the outer circumference of the bearing sleeve forming the friction bearing 2 is connected to a lubricating oil channel 10 of the internal combustion engine by way of a tapped bore 11. A bore 13 leads from the annular space 12 to the bearing surface of the sleeve or friction bearing 2. A bore 15 which is closed off at the end of the intermediate gear shaft 4 by a closure ball 14 is disposed in the center longitudinal axis of the intermediate gear shaft 4, from which a radial bore 16 leads within the area of the slide bearing 2 to an annular space 17 in the intermediate gear shaft 4. Only a metered quantity of lubricating oil enters from the bore 13 into the bore 16 and therewith into the bore 15. Possibly an additional aggregate may be supplied with lubricant by way of the space between the closure ball 14 and the bolt closing off the intermediate gear shaft 4, in that, for example, the bolt is provided with a through-bore.

Within the area of the friction or slide bearing 3, a radial bore 18 leads from the bore 15 to the bearing sleeve forming the friction or slide bearing 3, whereby an oil pocket 19 disposed in the longitudinal direction of the bearing is provided in the bearing surface thereof. A radial bore 20 then leads from the oil pocket 19 into a space 21 provided in the intermediate gear shaft 4 and located in front of the end face of the cam shaft 7, which is sealed off against the outside by means of suitable sealing means, for example, by means of an O-ring, and which is operatively connected with the space 24 in the injection pump 8 by way of a bore 22 located in the center longitudinal axis of the cam shaft 7 and by way of a radial bore 23 through the cam shaft 7. The bores 18 and 20 which together with the oil pocket 19 form the second metering device are disposed offset to one another in the circumferential direction, as can be seen in particular from FIG. 2, in such a manner that a connection between the bores exists by way of the oil pocket 19 only for a short period of time. By an appropriate selection of the offset of the bores 18 and 20 and the size of the oil pocket 19, the oil quantity metered in the first metering device can be matched even more finely to the lubricating requirements of the injection pump.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An installation for the metered lubrication of an injection pump connected with an internal combustion engine, in which a cam shaft is driven by an intermediate gear shaft non-rotatably connected with the cam shaft, said intermediate gear shaft being rotatably supported in the internal combustion engine on two slide bearing means and being lubricated from a connection to a lubricating oil channel of the internal combustion engine, characterized in that at least one of the slide bearing means of the intermediate gear shaft is constructed in conjunction with the intermediate gear shaft as metering means, and in that the metered lubricating oil, after leaving said last-mentioned slide bearing means, is conducted by way of a sealed space formed within the area of the connecting place between the cam shaft and the intermediate gear shaft, to a central bore through the cam shaft of the injection pump, from where the lubricating oil reaches the injection pump through a radial bore.

2. An installation according to claim 1, characterized in that the injection pump is flangedly connected to the internal combustion engine.

3. An installation according to claim 1, characterized in that both slide bearing means are constructed as metering means which are disposed one behind the other.

4. An installation according to claim 3, characterized in that for purposes of forming the one metering means, said lubricating oil channel is operatively connected with an annular space of said one bearing means of the intermediate gear shaft, said annular space being operatively connected with a bore in the center longitudinal axis of the intermediate gear shaft by way of a radial bore through the one bearing means and by way of a radial bore with an annular space in the intermediate gear shaft, the second metering means being operatively connected with the bore in the center longitudinal axis of the intermediate gear shaft.

5. An installation according to claim 4, characterized in that the radial bore in the one bearing means is slightly offset in the axial direction with respect to the radial bore in the intermediate gear shaft.

6. An installation according to claim 4, characterized in that for purposes of forming the other metering means, the bore in the center longitudinal axis of the intermediate gear shaft is operatively connected by way of a radial bore with an oil pocket means provided in the other slide bearing means, from which the lubricating oil flows by way of a second radial bore disposed offset in the circumferential direction of the intermediate gear shaft with respect to the bore in communication with the oil pocket means, the space formed between the two shafts and from there the central bore in the cam shaft.

7. An installation according to claim 6, characterized in that the radial bore in the one bearing means is slightly offset in the axial direction with respect to the radial bore in the intermediate gear shaft.

8. An installation according to claim 7, characterized in that the injection pump is flangedly connected to the internal combustion engine.

9. An installation according to claim 1, characterized in that for purposes of forming the one metering means said lubricating oil channel is operatively connected with an annular space of said one bearing means of the intermediate gear shaft, said annular space being operatively connected with a bore in the center longitudinal axis of the intermediate gear shaft by way of a radial bore through the one bearing means and by way of a radial bore with an annular space in the intermediate gear shaft, the second metering means being operatively connected with the bore in the center longitudinal axis of the intermediate gear shaft.

10. An installation according to claim 9, characterized in that the radial bore in the one bearing means is slightly offset in the axial direction with respect to radial bore in the intermediate gear shaft.

11. An installation according to claim 1, characterized in that for purposes of forming the other metering means, a bore in the center longitudinal axis of the intermediate gear shaft is operatively connected by way of a radial bore with an oil pocket means provided in the slide bearing means, from which the lubricating oil flows by way of a second radial bore disposed offset in the circumferential direction of the intermediate gear shaft with respect to the bore in communication with the oil pocket means, the space formed between the two shafts and from there the central bore in the cam shaft.

* * * * *